US006926184B2

(12) United States Patent
Hancock et al.

(10) Patent No.: US 6,926,184 B2
(45) Date of Patent: Aug. 9, 2005

(54) SUSPENDED ARTICLE COVER HOLD DOWN SYSTEM

(75) Inventors: Dennis Hancock, Mountain Green, UT (US); Jeffrey D. Hancock, Uintah, UT (US)

(73) Assignee: HHH Enterprises LLC, Evanston, WY (US)

( * ) Notice: Subject to any disclaimer, the term of this patent is extended or adjusted under 35 U.S.C. 154(b) by 102 days.

(21) Appl. No.: 10/347,269

(22) Filed: Jan. 21, 2003

(65) Prior Publication Data

US 2004/0140335 A1 Jul. 22, 2004

(51) Int. Cl.[7] ..... A45F 3/14

(52) U.S. Cl. ..... 224/637; 224/638; 224/259; 224/909

(58) Field of Search ..... 224/604, 605, 224/627, 638, 648, 649, 654, 655, 259, 262, 908, 909, 257–258, 609; 359/409

(56) References Cited

U.S. PATENT DOCUMENTS

| | | | | | |
|---|---|---|---|---|---|
| 2,643,803 | A | * | 6/1953 | Bates | 224/909 |
| 3,152,738 | A | * | 10/1964 | Worsfold Jr. | 224/259 |
| 4,232,808 | A | * | 11/1980 | Gray | 224/909 |
| 4,461,411 | A | * | 7/1984 | Harrow | 224/908 |
| 5,016,797 | A | * | 5/1991 | Rowledge | 224/649 |
| 5,320,261 | A | * | 6/1994 | Andersen | 224/909 |
| RE37,155 | E | | 5/2001 | Andersen | |
| 6,305,538 | B1 | * | 10/2001 | Jackson | 224/909 |
| 6,648,191 | B2 | | 11/2003 | Giggleman | |
| 2003/0029895 | A1 | | 2/2003 | Andersen | |
| 2004/0178239 | A1 | | 9/2004 | Hancock et al. | |

OTHER PUBLICATIONS

"Bino Buddy Binocular Strap," *Cabela's*, www.cabelas.com, 1 page (Date first available unknown).
"Bino–hide," *Sportsman Outdoor Products*, (Product Package—date unknown).
"Butler Creek Bino Buddy," *Cabela's*, www.cabelas.com, 1 page (Date first available unknown).
"Dual Strap Binocular Harness," *Cabela's*, (Product Package—date unknown).
"Slide & Flex Bino System," *Crooked Horn Outfitters*, www.crookedhorn.com, 2 pages (Believed to have been on sale before Jan. 17, 2002).

* cited by examiner

*Primary Examiner*—Nathan J. Newhouse
(74) *Attorney, Agent, or Firm*—Merchant & Gould P.C.

(57) ABSTRACT

A system for holding an article suspended by shoulder straps in front of the body of a use against undesired swinging and movement of the article while affording easy release of the article so that it can be raised for viewing, aiming and sighting and that will provide protection for the suspended article against the elements. and including a cover to fit over an outer exposed surface, the bottom and top of the article and that has a hinged lip manipulated by a pull tab to drop into the space between the article and the body of the user when the cover is fully in place

16 Claims, 5 Drawing Sheets

SUSPENDED ARTICLE COVER HOLD DOWN SYSTEM

CROSS REFERENCE TO RELATED APPLICATIONS

Not Applicable

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

This invention relates to cover apparatus for holding strap supported articles in place against the chest of a user while the articles are being carried and not in use.

There are many situations where users want to have an article such as binoculars, a camera or eyeglasses ready and available for immediate use but do not want to have to carry the article in hand, or in a carrying case dangling on the end of a neck strap. With the article carried in hand the hand is no longer available for other activities. If a carrying case is used the article contained therein can usually only be retrieved for use by unlocking the case and withdrawing the article. Often, this procedure is so slow that by the time the article is pulled from the case it is too late for the user to use the article in the manner desired. Furthermore, a neck suspended article case swings and flops against the chest of a person carrying the article as well as from side to side. Even if a carrying case is not used and the article itself is suspended from a neck strap the article swings and flops and is often annoying and uncomfortable to the user as various activities are performed. Running, climbing over or through fences, riding on or in various vehicles and even riding in a boat in rough water are typical of activities that will cause neck strap suspended articles, whether or not in a carrying case, to repeatedly hit and bounce off the chest or stomach of a user.

The users of neck suspended articles often desire to have quick access to the article and do not want to take the time necessary to remove them from carrying cases. Nevertheless, such user's often want their carried articles protected against the elements and may desire to have them protect against glare and sun reflections and/or to be camouflaged.

BRIEF SUMMARY OF THE INVENTION

It is a principal object of the present invention to provide a system for carrying chest positioned articles such that the articles will be restrained against undesired swinging against the body of the user and from side to side. Another object is to provide a cover system for carrying supported articles that will permit fast and easy movements to remove a protective cover and to release the article from a hold down position to a use position.

Still other objects are to provide apparatus for supporting articles such as binoculars, cameras and eyeglasses that are commonly suspended by a neck strap against the chest area of a user and that are commonly used by raising them to appropriate eye level to permit viewing and aiming. Yet other objects are to provide cover apparatus that is easy to use, long lasting, suitable for use with a wide variety of articles and that is inexpensive to manufacture so that it is readily available to a wide range of users.

Principal features of the invention include a cover assembly including a pair of shoulder straps each having one end connected to a side of an article to be suspended; a spreader to which the other ends of the shoulder straps are secured; a pair of underarm straps, each having one end fixed to the spreader and another end attached to a non-resilient (non-elastic) article cover. The shoulder straps and underarm straps are each made of interconnected stretchable elastic and non-stretchable fabric materials and are made to be adjusted lengthwise, as necessary to accommodate the body size and shape of a user. The non-resilient cover is shaped to overlie the article and is curved beneath the article and has a curved upper end with a articles that will permit fast and easy movements to remove a protective cover and to release the article from a hold down position to a use position.

Still other objects are to provide apparatus for supporting articles such as binoculars, cameras and eyeglasses that are commonly used by raising them to appropriate eye level to permit viewing and aiming. Yet other objects are to provide cover apparatus that is easy to use, long lasting, suitable for use with a wide variety of articles and that is inexpensive to manufacture so that it is readily available to a wide range of users.

Principal features of the invention include a cover assembly including a pair of shoulder straps each having one end connected to a side of an article to be suspended; a spreader to which the other ends of the shoulder straps are secured; a pair of underarm straps, each having one end fixed to the spreader and another end attached to a non-resilient (non-elastic) article cover. The shoulder straps and underarm straps are each made of interconnected stretchable elastic and non-stretchable fabric materials and are made to be adjusted lengthwise, as necessary to accommodate the body size and shape of a user. The non-resilient cover is shaped to overlie the article and is curved beneath the article and has a curved upper end with a substantially rigid upper lip to fold over an upper end of the article as the cover is installed and removed.

Additional objects and features of the invention will become apparent to those skilled in the art to which the invention pertains from the following detailed description and drawings.

DETAILED DESCRIPTION OF THE INVENTION

Figure 1:
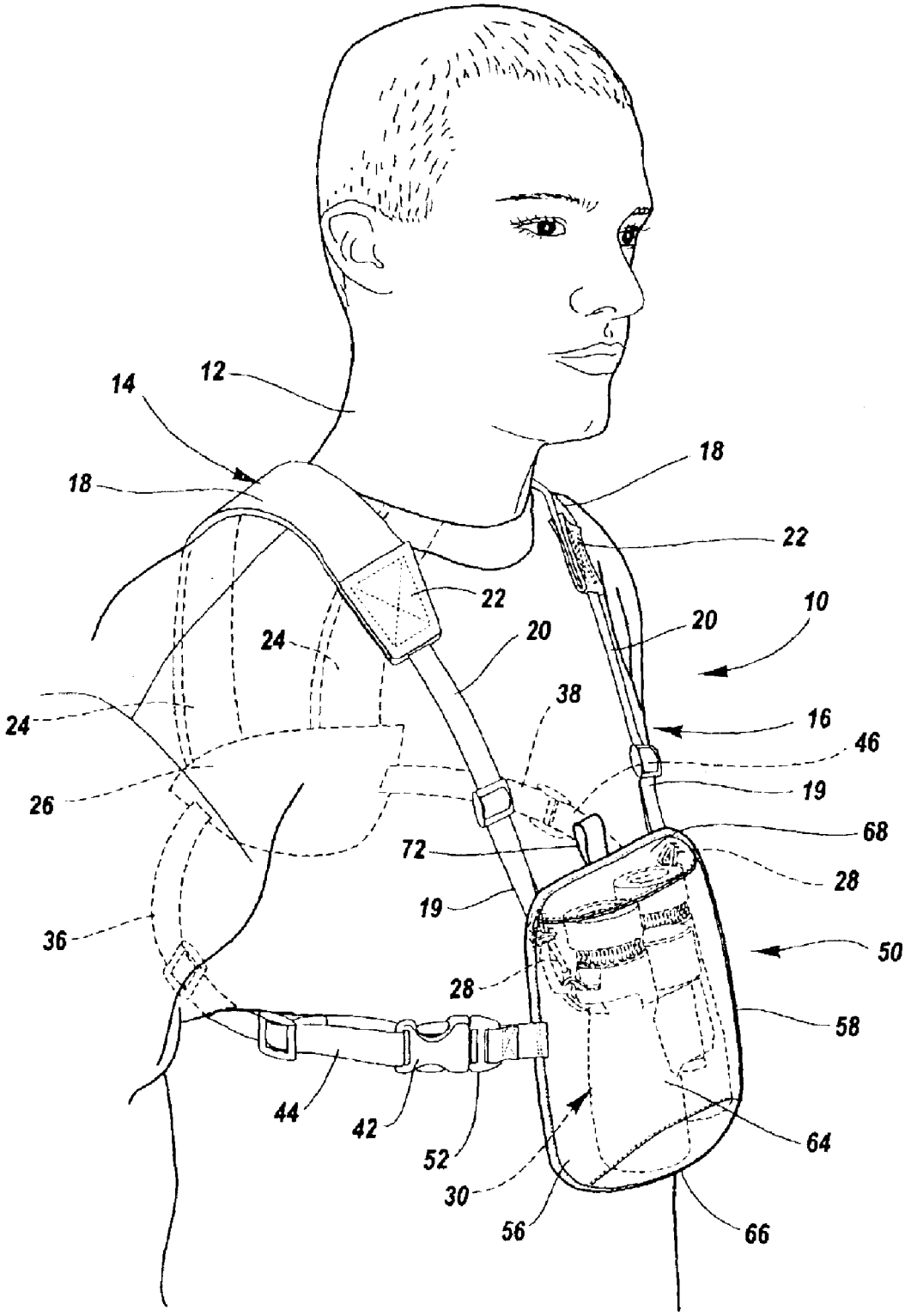
FIG. 1 is a pictorial right/front view of the chest supported covered article holder of the invention on a user and with the neck supported article (binoculars) secured against undesired movement.
Figure 2:
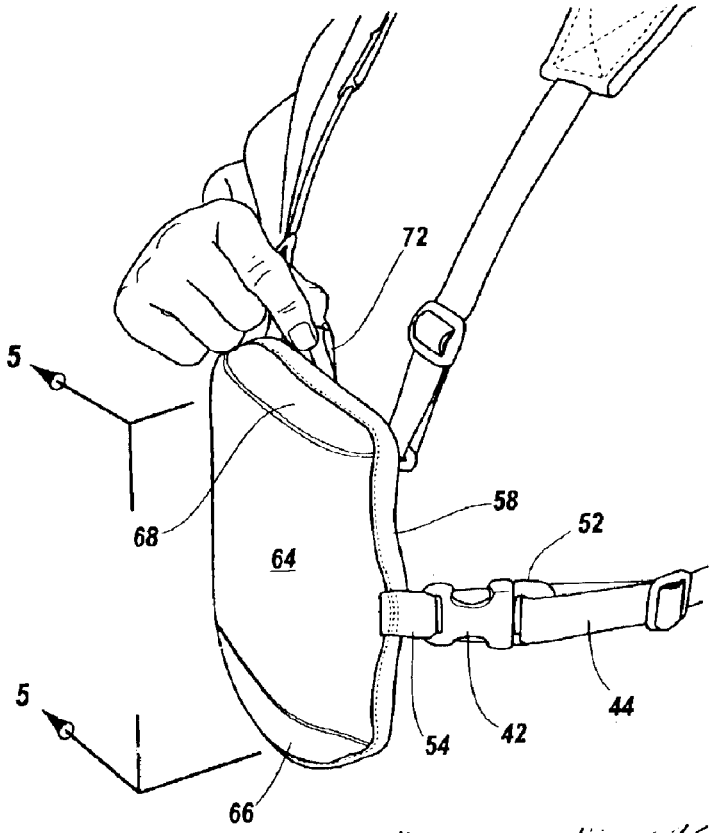
FIG. 2, a pictorial left/front view, showing initial movement in removing the installed cover.
Figure 3:
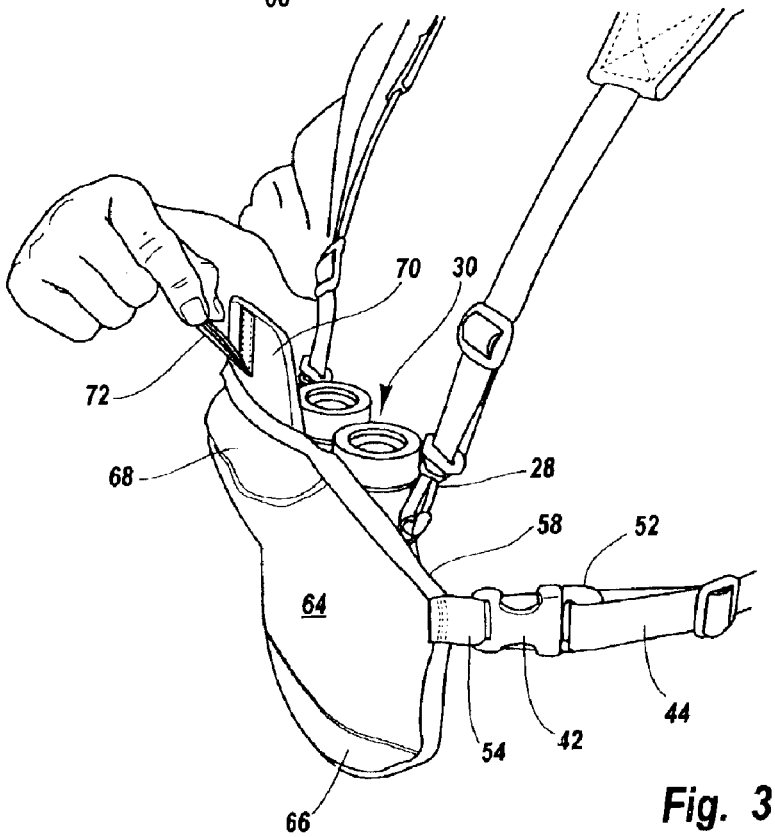
FIG. 3, a similar view, showing continued removal of the cover.
Figure 4:
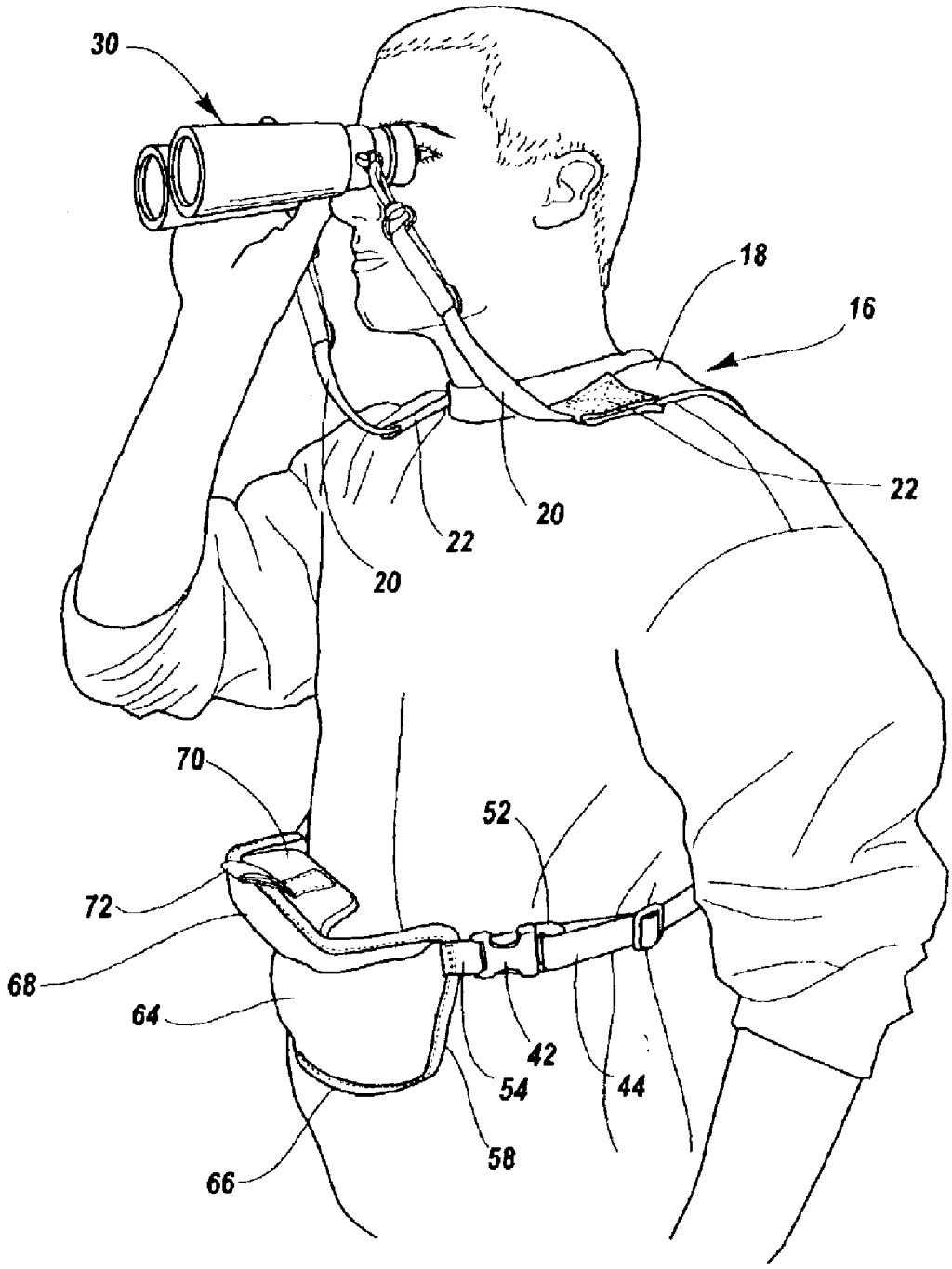
FIG. 4, a view like that of FIG. 1, but showing the cover removed and the article (binoculars) raised to eye level.

Referring now to the Drawings:

In the illustrated preferred embodiment of the invention the suspended article hold down system is shown generally at 10, worn by a user 12.

System 10 includes a pair of shoulder straps 14 and 16, each having a resilient (elastic) length 18 and an adjustable non-resilient (non-elastic) length 20. A reinforcement pad 22 is provided at each of the connections between the lengths 18 and the lengths 20.

One end 24 of each shoulder strap 14 and 16 is connected to a flat spreader 26 and, in use, each strap extends from the spreader upwardly from the back of a user and over a shoulder of the user. A snap connector 28 is connected to turned back ends of each non-resilient length 20 of each shoulder strap 14 and 16. The snap connectors 28 of the respective straps 14 and 16 are attached to opposite sides of an article, shown in FIG. 1 as binoculars 30, that is commonly suspended by a strap (not shown) from the neck of the user.

A pair of adjustable length underarm straps 36 and 38 each have one end 40 attached to spreader 26. Each underarm strap 36 and 38 extends from the spreader 26 beneath an arm of the user 12 and around the front of the user. A quick coupling receptacle 42 is connected to turned back ends 44 and 46 respectively of the underarm straps 36 and 38.

A cover, shown generally at 50 has coupling inserts 52 and 54 secured at opposite sides 56 and 58 thereof. The coupling inserts are pushed into the coupling receptacles 42 at opposite sides of the cover to lock the cover to the underarm straps. The coupling inserts are released from the coupling receptors by actuation of the coupling receptors.

Cover 50 has sides 60 and 62 interconnected by a face sheet 64. Face sheet 64 is curved at a bottom edge 66 so that it will extend beneath an article supported by the shoulder straps 14 and 16. A top edge 68 of the face sheet is curved to extend over the top of a suspended article (binoculars 30). A substantially rigid lip 70 is hinged along the top edge 68 and has a flexible tab 72 projecting centrally thereof.

Figure 5:
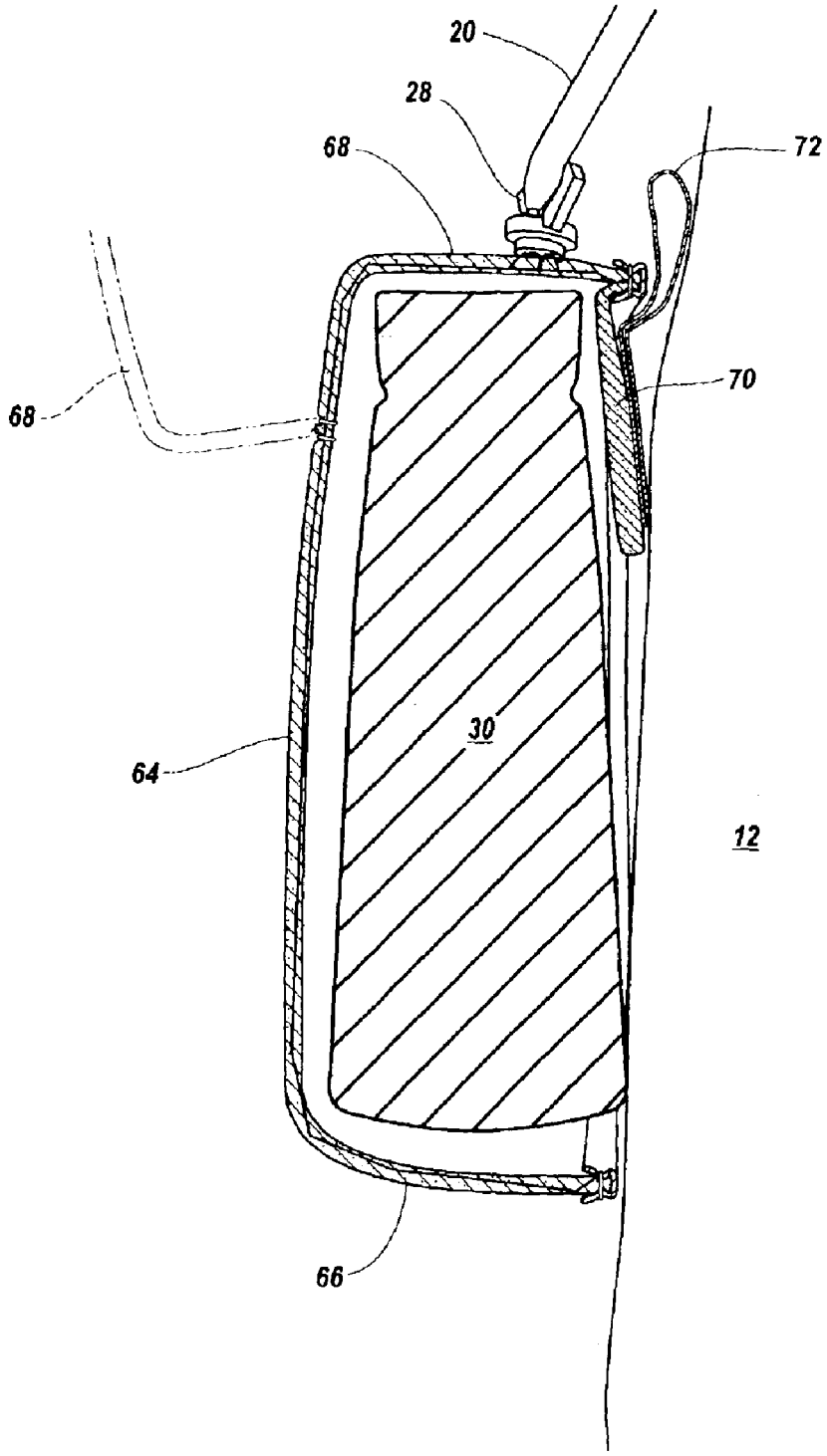
FIG. 5, an enlarged vertical section, taken on the line 5—5 of FIG. 2.
Figure 6:
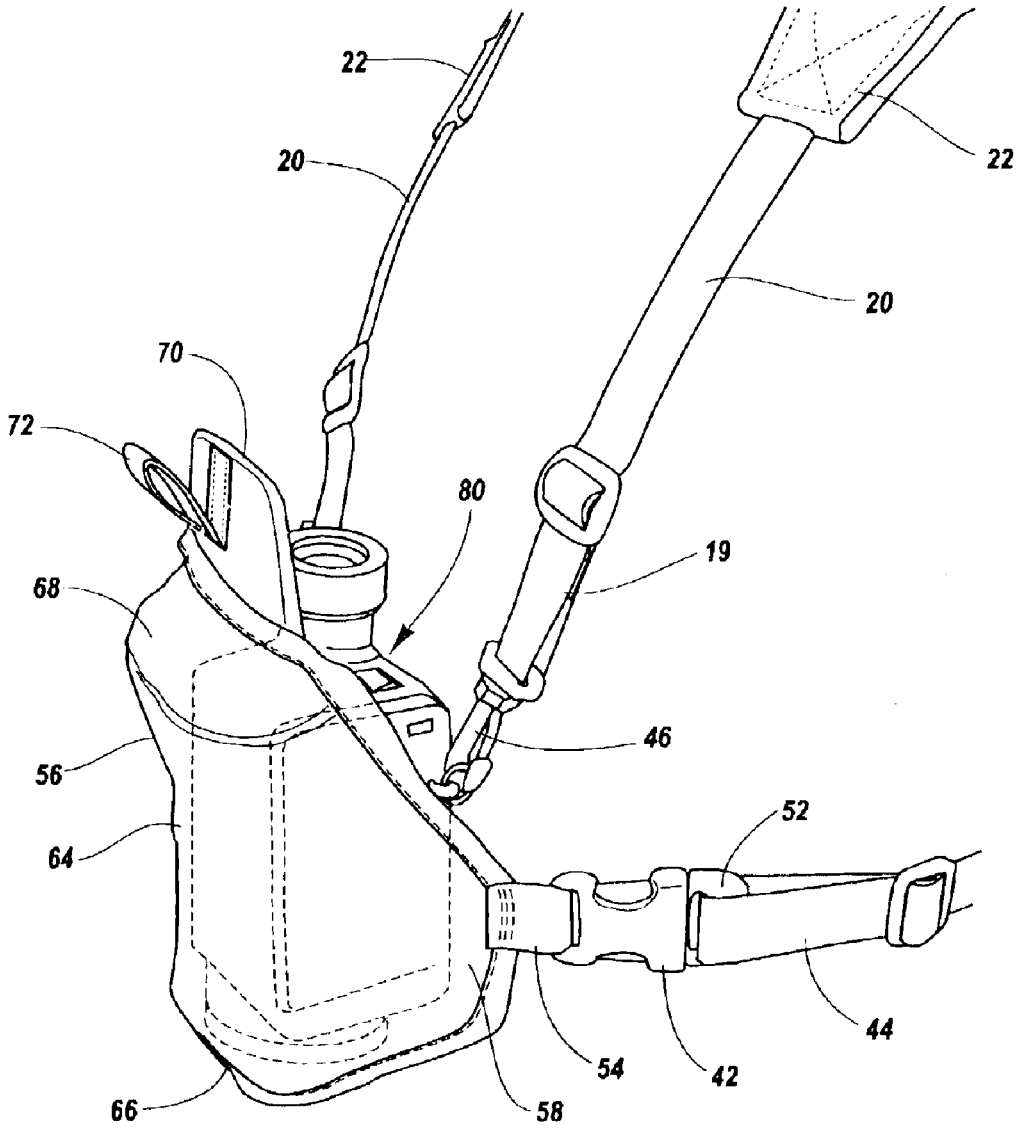
FIG. 6, a view like that of FIG. 3, but showing a different article (camera) and the cover being installed to protect the camera and to secure the camera against undesired movement.

In using the suspended article hold down system 10 of the invention a user 12 will position spreader 26 flat against his back and the shoulder straps 14 and 16 to extend over his shoulders. The shoulder straps are them connected to an article (binoculars 30) or another article such as the camera 80 shown in FIG. 5. Cover 50 is arranged with bottom edge 66 beneath the article and tab 72 is pulled up tp place the top edge 68 over the top of the and that other variations are possible without departing from the subject matter coming within the scope of the following claims, which subject matter we regard as our invention.

We claim:

1. A suspended article cover hold down system, comprising:

a pair of adjustable length shoulder straps to fit over opposing shoulders of a user;

a snap hook on one end of each shoulder strap for connection of the strap to one side of an article to be suspended in front of a user;

a flat spreader connected to opposite ends of said shoulder straps;

a pair of adjustable length underarm straps each having one end connected to said spreader and having sufficient length to extend from said spreader at the back of said user, beneath the arms of the user, to the front of the user;

a cover to fit over the surface of the article suspended by said shoulder straps remote from the user, said cover being connected between ends of said underarm straps remote from said spreader, the cover including a face sheet interconnecting the spaced apart sides to which the ends of the underarm straps are connected, said face sheet being curved to form a bottom edge to be beneath the bottom of the article suspended by the shoulder straps and curved to form a top edge to be above an upper end of the article, the cover further including a substantially rigid lip hinged to the top edge that will pivot into the space between the article and the body of the user; and a releasable coupling interconnecting each side of the cover to an underarm strap.

2. A suspended article cover hold down system as in claim 1, wherein the lip has a flexible tab projecting there from to be grasped to pivot and move said lip.

3. A suspension article cover hold down system as in claim 1, wherein the shoulder straps each have a resilient length and a non-resilient length.

4. A suspension article cover hold down system as in claim 1, wherein the shoulder straps are coupled to the article only at the front side of the user, and are not coupled to the cover or the underarm straps at the front of the user.

5. A suspended article cover hold down system, comprising:

a pair of interconnected shoulder straps to extend from the back of a user, over the shoulders of the user, to the front of the user;

hook means at one end of each at said shoulder straps to connect to one side of an article to be suspended by said shoulder straps;

a pair of interconnected underarm straps to extend from the back of the user to the front of the user;

a cover having a pair of spaced apart sides, connector means projecting from each said side, a face sheet interconnecting said sides, a curved bottom interconnecting said face sheet and said sides and a curved top interconnecting said face sheet and said sides, a substantially rigid lip hinged to said top and a pull tab connected to said lip, whereby pulling on the tab will pivot the top to peel the cover from or to install the cover over an article suspended by said shoulder straps.

6. A method of suspending and covering an article over shoulders of a user, the method comprising:

positioning a flat spreader at a rear side of the user;

positioning first and second shoulder straps over first and second shoulders of the user, each shoulder strap including first and second ends, wherein the second ends of the shoulder straps are coupled to the flat spreader at the rear side of the user, and the first ends of the shoulder straps are coupled to the article to suspend the article at a front side of the user;

positioning first and second underarm straps under separate arms of the user, each underarm strap including first and second ends, wherein the second ends of the underarm straps are coupled to the flat spreader;

coupling a cover member between the first ends of the underarm straps; and positioning the article between the user and the cover member to hold the article in a desired position and to at least partially cover the article.

7. The method of claim 6, wherein the shoulder straps comprise a resilient material.

8. The method of claim 6, wherein the shoulder straps are coupled to the article only at the front side of the user, and are not coupled to the cover member or the underarm straps at the front of the user.

9. The method of claim 6, wherein positioning the article includes moving a portion of the cover member away from the user, positioning the article in the space provided between the cover member and the user, and releasing the moved portion of the cover member.

10. The system of claim 9, wherein the cover member includes opposing sides, a face sheet, and a top interconnecting said face sheet and said sides, the top defining that portion of the cover member that is movable away from the user to provide access to a space defined between the cover member and the user's body, the space being sized for at least a portion of the article.

11. The system of claim 10, wherein the cover member further includes a substantially rigid lip hinged to said top and a pull tab connected to said lip, whereby pulling on the tab will pivot the top to peel the cover member from or to install the cover member over the article suspended by said shoulder straps.

12. A suspended article hold down system, comprising:

a pair of shoulder straps to fit over the shoulders of a user, each shoulder strap having first and second ends, the first end being positioned at a front side of the user and the second ends being positioned at a rear side of the user;

a separate connector coupled to the first end of each shoulder strap for connection of the strap to an article to be suspended by the hold down system;

a flat spreader coupled to the second end of each shoulder strap;

a pair of adjustable length underarm straps each having first and second ends, the first end being positioned at the front of the user and the second end being coupled to the spreader, wherein each underarm strap extends beneath an arm of the user; and a cover to fit over the surface of the article suspended by the shoulder straps, the cover being connected between the first ends of the underarm straps and oriented to extend over the article suspended by the shoulder straps to hold the article against the user and at least partially cover the article.

13. The system of claim 12, wherein the shoulder straps each have a resilient length and a non-resilient length.

14. The system of claim 12, wherein the shoulder straps are coupled to the article only at the front side of the user, and are not coupled to the cover or the underarm straps at the front of the user.

15. The system of claim 12, wherein the cover includes opposing sides, a face sheet, and a curved top interconnecting said face sheet and said sides, the curved top being movable to provide access to a space defined between the cover and the user's body.

16. The system of claim 15, wherein the cover further includes a substantially rigid lip hinged to said top and a pull tab connected to said lip, whereby pulling on the tab will pivot the top to peel the cover from or to install the cover over an article suspended by said shoulder straps.

* * * * *

UNITED STATES PATENT AND TRADEMARK OFFICE

CERTIFICATE OF CORRECTION

PATENT NO. : 6,926,184 B2
APPLICATION NO. : 10/347269
DATED : August 9, 2005
INVENTOR(S) : Hancock et al.

It is certified that error appears in the above-identified patent and that said Letters Patent is hereby corrected as shown below:

Title page, (73) Assignee: "HHH Enterprises LLC, Evanston, WY" should read --Stearns Inc., Sauk Rapids, MN--

Col. 2, lines 4-18: Delete the paragraph starting with "Principal features" and ending with "to a use position." because it is a duplicate paragraph.

Col. 2, line 19-27: Delete the paragraph starting with "Still other objects" and ending with "wide range of users." because it is a duplicate paragraph.

Signed and Sealed this

Fifth Day of September, 2006

JON W. DUDAS
*Director of the United States Patent and Trademark Office*